United States Patent [19]

Whitfield

[11] Patent Number: 5,048,582

[45] Date of Patent: Sep. 17, 1991

[54] COMPARTMENTED HANDBAG WITH DIRECTIONAL MAP

[76] Inventor: Georgia L. Whitfield, 9652 S. Oblesvy, Chicago, Ill. 60617

[21] Appl. No.: 634,014

[22] Filed: Dec. 26, 1990

Related U.S. Application Data

[63] Continuation-in-part of Ser. No. 546,308, Jul. 3, 1990.

[51] Int. Cl.[5] ..... A45C 1/02; A45C 3/06; A45C 13/00

[52] U.S. Cl. ..... 150/112; 150/117; 190/102; 190/109; 190/111; 190/112

[58] Field of Search ..... 150/100, 106, 112, 117; 190/111, 112, 102, 109

[56] References Cited

U.S. PATENT DOCUMENTS

| | | | |
|---|---|---|---|
| 979,763 | 12/1910 | Hollis | 150/112 |
| 1,560,442 | 11/1925 | Trowbridge | 150/112 |
| 1,739,634 | 12/1929 | Friedman | 150/112 X |
| 2,467,662 | 4/1949 | Freiberg | 150/117 |
| 2,477,388 | 7/1949 | Moore | 150/112 |
| 2,608,228 | 8/1952 | Rose | 150/112 |
| 2,675,042 | 4/1954 | Herrera | 150/112 |
| 2,904,091 | 9/1959 | Reed | 150/117 |
| 3,202,191 | 8/1965 | Kaplan | 150/117 |
| 4,532,972 | 8/1985 | Sinsko | 150/106 X |
| 4,739,809 | 4/1988 | Adams | 150/112 |

FOREIGN PATENT DOCUMENTS

| | | | |
|---|---|---|---|
| 177127 | 11/1906 | Fed. Rep. of Germany | 150/106 |
| 1104340 | 11/1955 | France | 150/106 |

*Primary Examiner*—Sue A. Weaver
*Attorney, Agent, or Firm*—Leonard J. Kalinowski

[57] ABSTRACT

A compartmented handbag having a plurality of interior compartments includes a directional map that identifies the contents and/or locations of the compartments within the handbag, making the contents of the compartments easily accessible. The compartments are numbered and the directional map includes a list of the numbered compartments and identifying indicia which is individually correlated to correspond with the compartments.

9 Claims, 3 Drawing Sheets

FIG. 1
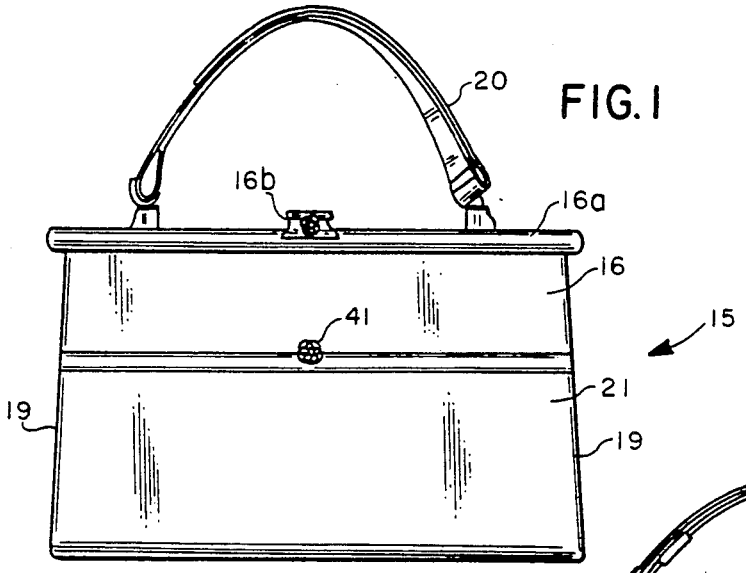
FIG. 2
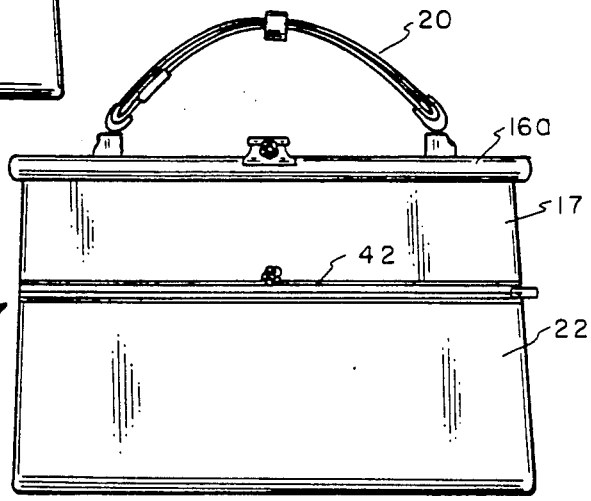
FIG. 3
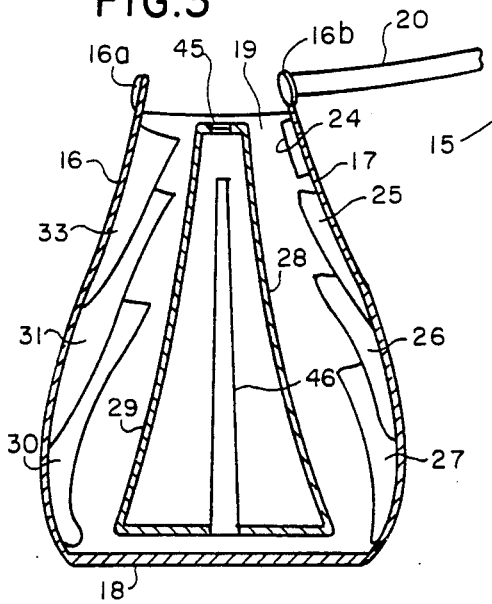
FIG. 4A
60
| | |
|---|---|
| 1 KEYS | 7 BILLFOLD |
| 2 MIRROR | 8 PENS |
| 3 GLASSES | 9 SEWING |
| 4 COSMETICS | 10 PERFUME |
| 5 COMB | 11 |
FIG. 4B
60a
| | |
|---|---|
| 1 KEY | 7 BILL |
| 2 MIR. | 8 PEN |
| 3 GLAS. | 9 SEW. |
| 4 COS. | 10 PERF. |
| 5 COMB | 11 |
FIG. 4C
60b
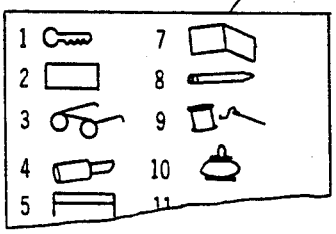
FIG. 4D
60c
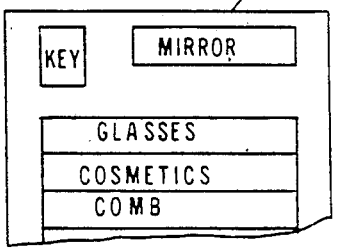

COMPARTMENTED HANDBAG WITH DIRECTIONAL MAP

RELATED APPLICATION

This is a continuation-in-part application of Ser. No. 07,546,308, filed July 3, 1990, entitled ALL-A-BAG.

BACKGROUND OF THE INVENTION

This invention relates to handbags, and more particularly to an organized handbag having a directional map that makes contents of the handbag easily accessible.

In the past, women have had to fight with their purses to find objects that have fallen to the bottom. The handbag according to the present invention alleviates that problem because everything is kept in a compartment organized and in place. No longer will women be unnecessarily exposed to dangerous elements while searching for keys to get into their car or home, or looking for change while waiting at a bus stop.

Most handbag organizers in the average handbag do not specifically label all compartments, nor do they attempt to organize the entire contents of the handbag. However, the handbag according to the present invention includes a directional map which makes all contents of the purse organized and easily accessible.

SUMMARY OF THE INVENTION

The present invention provides a handbag including a directional map that makes all contents easily accessible. The handbag includes numbered compartments that maintain the contents of the purse organized and in place. The directional map correlates the compartments with the contents of the compartments and in one embodiment indicates the location of each compartment within the handbag. In accordance with a preferred embodiment, the handbag includes twelve compartments located within the handbag, each compartment being individually labeled with indicia to correspond with indicia on the directional map which comprises a label or the like which is sewn on the inside of the handbag.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a front elevational view of a handbag incorporating the directional map in accordance with the present invention;

FIG. 2 is a rear elevational view of the handbag illustrated in FIG. 1;

FIG. 3 is an end sectional view of the handbag illustrated in FIG. 1;

FIGS. 4A, 4B, 4C and 4D illustrate different embodiments for the directional map;

DESCRIPTION OF PREFERRED EMBODIMENTS

Figure 4:
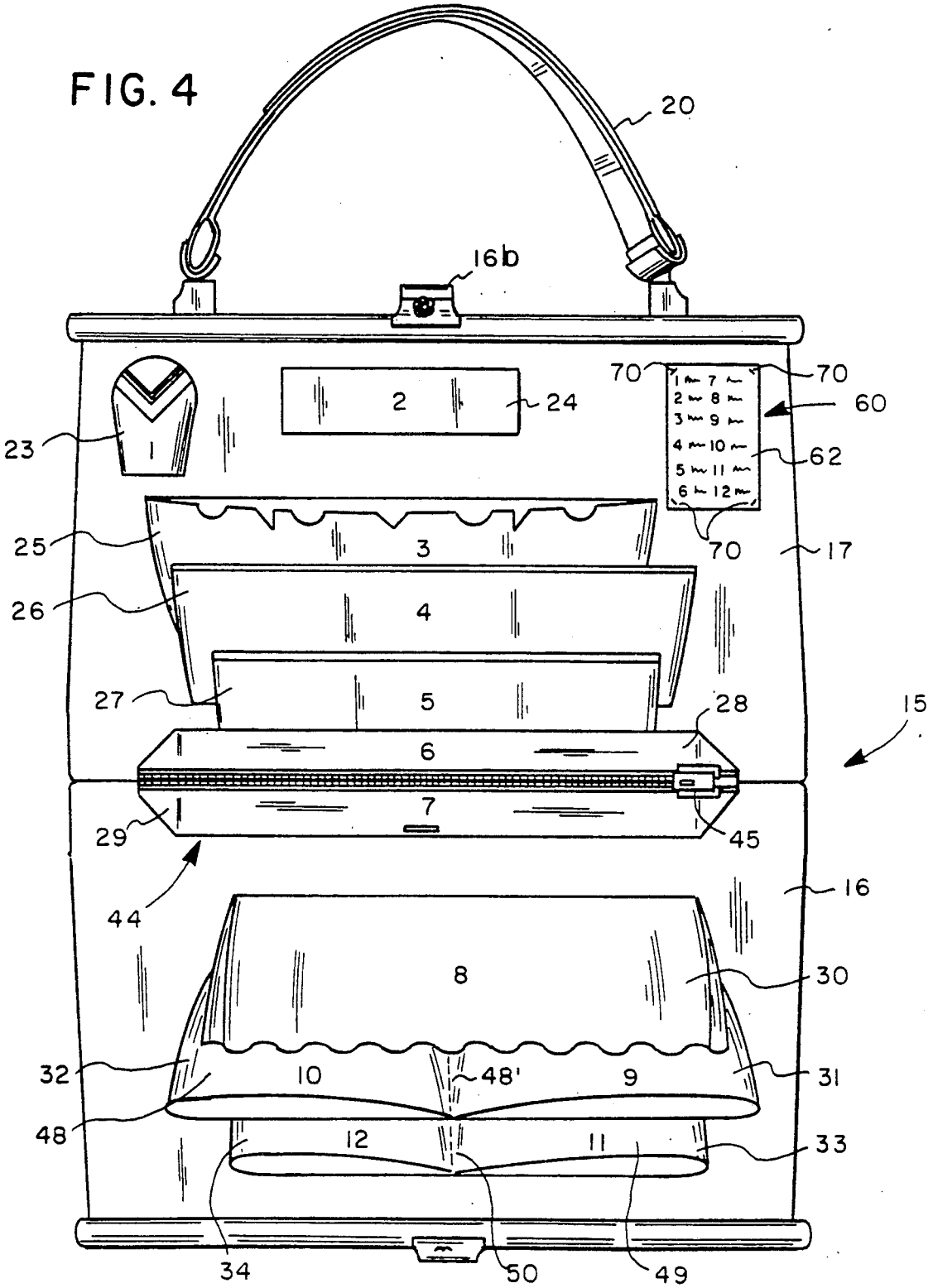
FIG. 4 is a top view of the handbag of FIG. 1, shown open to illustrate the compartments and directional map.

Referring to FIGS. 1-3, the directional map in accordance with the present invention is incorporated into a compartmented handbag 15. The handbag 15 has a front panel 16, a back panel 17, a bottom panel 18, and expandable side panels 19. The handbag includes frame members **16*a* at the tops of the front and rear panels provided with a clasp 16*b*. A suitable carrying strap or handle 20 is secured to one of the frame members. The handbag 15 has a front pocket or compartment 21 on its forward side (FIG. 1), a rear pocket or compartment 22 on its rearward side (FIG. 2) and twelve additional compartments 23-34 located in the interior of the handbag (FIGS. 3-4). The construction of the handbag 15** including the panels and the compartments may be conventional, but is adapted to include the directional map and to have its compartments labeled in accordance with the present invention.

The front compartment 21 is adapted to receive books, magazines and the like. The compartment 21 is closable by a snap closure device 41.

The rear compartment 22 may contain loose change, a bus pass, a train ticket, or the like and is closable by a slide fastener 42, for example.

Referring to FIGS. 3-4, compartment 23 may be a key compartment for holding house keys and/or car keys. Compartment 24 is a mirror compartment which may contain a mirror (not shown) to be used for cosmetic purposes. Alternatively, the compartment 24 may be replaced by a mirror which is secured to the inner wall of the handbag.

Compartment 25 may be used to store glasses, contact lenses, sun glasses, or the like. Compartment 26 may be used to hold any or all cosmetics. Compartment 27 may be used to store combs and brushes and the like. It is pointed out that compartments 23-27 store similar elements, i.e., elements for grooming or make-up purposes.

Compartment 28 stores a checkbook and credit cards. Compartment 29 is specifically designed to store a billfold or the like. Compartments 28 and 29 are subdivisions of a common compartment 44 which is closed by a slide fastener 45. The compartment 44 includes an inner dividing wall 46 of fabric which defines the two subcompartments 28, 29.

Compartment 30 is specifically designed for storing pens, pencils, and the like. Compartments 31 and 32 are defined by a single fold of material 48 which is stitched at its center 48' to compartments 32 and 31. Compartment 31 contains a sewing kit including suitable sewing repair items. Compartment 32 contains lotion and perfume, and the like.

Similarly, compartments 33 and 34 are formed by a single band of material 49 which is stitched to the wall along its center 50 defining compartments 33 and 34. Compartment 33 stores a tissue dispensary or the like and compartment 34 is used to hold a rain scarf.

Figure 5:
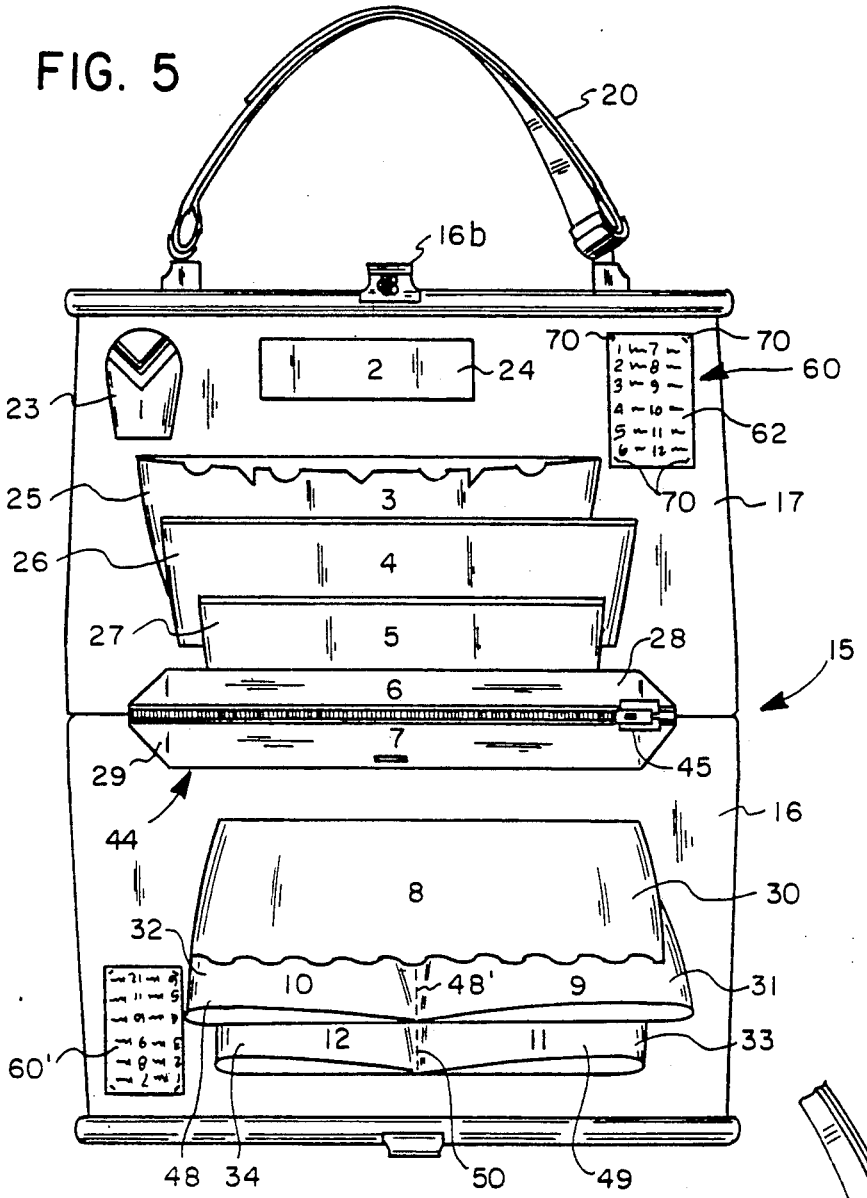
FIG. 5 is a view similar to FIG. 4 for a handbag including two directional maps.
Figure 6:
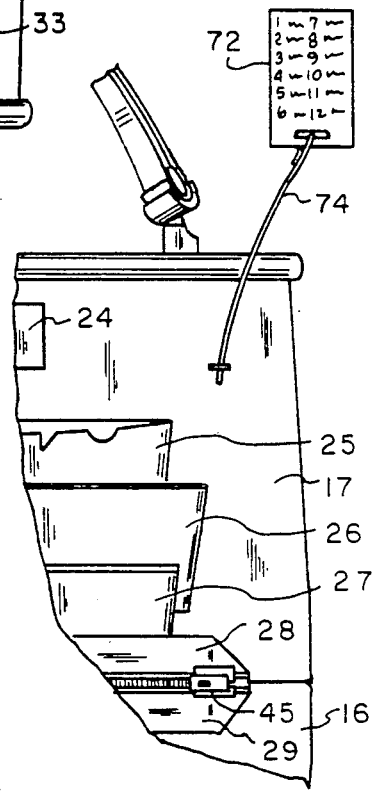
FIG. 6 illustrates a further embodiment of the directional map.

Each of the interior compartments 23-34 bear an identifying indicia, which in the exemplary embodiment are arabic numerals 1-12. In accordance with the present invention, the interior or the handbag also includes a directional map 60 which correlates and identifies each of the indicia bearing compartments with the items the compartments contain so that a user glancing at the map will immediately know the location of the compartment containing the item being sought. The handbag 15 may include a single directional map 60 located in the upper right hand corner of the interior of the handbag as illustrated in FIG. 4 or may contain two directional maps, as illustrated in FIG. 5, one such map 60 being located in the upper right hand corner, as viewed in FIG. 5 on the inner surface of the rearward side of the handbag and the other directional map 60' being located on the interior surface of the forward panel and so positioned as to be in the upper right hand corner when the orientation of the handbag 15 is reversed. The dual map arrangement enables the person using the handbag to view the directional map regardless of the front-to-back orientation of the handbag when it is being opened.

Referring to FIGS. 4A, the directional map is in the form of a list which correlates the compartment indicia, i.e., numbers 1-12 with the contents, as illustrated in FIG. 4A. The directional map 60 identifies the contents of each compartment by associating the compartment number, i.e., 1, 2, 3, etc., with an identifier word which identifies its contents, i.e., KEYS, MIRROR, GLASSES, etc.

Referring to FIG. 4B, in accordance with further embodiment, directional map **60*a* is similar to directional map 60** but includes abbreviations rather than the total identifier word for the compartment contents.

The directional map **60*b* illustrated in FIG. 4C employs symbols rather than identifying words. Thus, the indicia "1" for compartment 21 has associated therewith the picture of a "key"; the indicia "5" for compartment 27** has associated therewith a picture or representation of a "comb", etc.

In FIG. 4D there is illustrated yet another embodiment for a directional map **60*c* in which each of the compartments is identified by a legend but the compartments are laid out on the map in the same pattern as the compartments are located within the interior of the handbag. Thus, the person glancing at the directional map 60*c*** can tell at a glance not only which compartment contains the item being sought, but also the location of the compartment within the interior of the handbag.

The directional map 60 (or **60*a*-60*c*) may comprise a strip of fabric or material having the directional map information imprinted, sewn, or otherwise provided thereon. The directional map 60 is attached to the interior of the handbag as by sewing at locations 70 or by other suitable fastening means such as hook and latch type fasteners, adhesive backing, tacking, or the like. Also, although preferably the directional map 60** is provided on a fabric or material, it may also be a plastic or heavy paper material.

Moreover, in accordance with a further aspect of the invention, the directional map 60 (or **60*a*-60*c*) may be provided on a separate plastic or material backing member 72 which is attached to the interior of the handbag by way of a chain 74**, cord, or the like. In this embodiment, the directional map is readily located by the user by merely reaching for the chain or cord and orienting the backing member to a position in which the user can read the directional map to locate an item sought.

I claim:

1. In a handbag having a plurality of interior compartments constructed and arranged for storing articles, the improvement comprising: a directional map located within the handbag and bearing first indicia identifying each of the compartments and second indicia identifying the contents of the compartment identified by the first indicia, and each of said compartments bearing the corresponding first indicia contained on said directional map.

2. The handbag according to claim 1 wherein said directional map comprises a backing member secured to the interior of the handbag.

3. The handbag according to claim 2 wherein said backing member is made of a cloth fabric.

4. The handbag according to claim 2 wherein said backing member is made of plastic.

5. The handbag according to claim 2 wherein said backing member is secured to the interior of the handbag by sewing.

6. The handbag according to claim 2 wherein said backing member is secured to the interior of the handbag by hook and latch type fastening means.

7. The handbag according to claim 2 wherein said backing member is secured to the interior of the handbag by an elongated, flexible member.

8. The handbag according to claim 1 wherein said first indicia comprises arabic numerals and said second indicia comprises a descriptive word in alphabetical characters.

9. The handbag according to claim 1 wherein said first indicia comprises arabic numerals and said second indicia comprises symbols each associated with a different one of said arabic numerals.

* * * * *